US005355703A

United States Patent [19]

Elinski et al.

[11] Patent Number: 5,355,703

[45] Date of Patent: Oct. 18, 1994

[54] CYLINDRICAL LOCK WITH CAM DOWN RETAINING TUMBLER

[75] Inventors: Kevin J. Elinski; William D. Boppre, both of Milwaukee, Wis.

[73] Assignee: Briggs & Stratton Corporation, Milwaukee, Wis.

[21] Appl. No.: 71,344

[22] Filed: May 28, 1993

Related U.S. Application Data

[63] Continuation of Ser. No. 758,780, Sep. 12, 1991, abandoned.

[51] Int. Cl.[5] ..... E05B 63/00

[52] U.S. Cl. ..... 70/421; 70/368; 70/371

[58] Field of Search ..... 70/377, 371, 421, 370, 70/372, 367–369

[56] References Cited

U.S. PATENT DOCUMENTS

| | | | |
|---|---|---|---|
| 1,805,891 | 5/1931 | Shinn | 70/377 |
| 1,987,735 | 1/1935 | Falk | 70/377 |
| 1,990,934 | 2/1935 | Falk | 70/377 |
| 2,039,244 | 4/1936 | Lowe | 70/370 |
| 2,444,542 | 7/1948 | Swanson . | |
| 2,629,247 | 2/1953 | Deutsch . | |
| 2,766,611 | 10/1956 | Hagel | 70/377 |
| 3,137,156 | 6/1964 | Navarro | 70/377 |
| 3,402,582 | 9/1968 | Jacobi | 70/368 |
| 3,782,139 | 1/1974 | Rubner | 70/369 |
| 4,272,975 | 6/1981 | Patriquin . | |
| 4,416,129 | 11/1983 | Thimot | 70/377 |
| 4,565,080 | 1/1986 | Kincaid et al. | 70/370 |
| 4,672,827 | 6/1987 | Craig | 70/377 |
| 4,704,880 | 11/1987 | Schlindwein | 70/371 |
| 4,761,977 | 8/1988 | Weatherby | 70/377 |
| 5,186,031 | 2/1993 | Janssen et al. | 70/371 |
| 5,235,832 | 8/1993 | Lux et al. | 70/368 |

*Primary Examiner*—Peter M. Cuomo
*Assistant Examiner*—Darnell M. Boucher
*Attorney, Agent, or Firm*—Andrus, Sceales, Starke & Sawall

[57] ABSTRACT

A cylinder lock set includes a retaining tumbler which has a cammed outer tip adapted to be received in a receptive slot such that the cylinder may be rotated in the slot to engage the cammed outer tip of the retaining tumbler and cam down the tumbler into the cylinder to provide clearance between the slot and the cylinder for facilitating insertion of the cylinder into a receptive sleeve.

16 Claims, 3 Drawing Sheets

FIG. 8
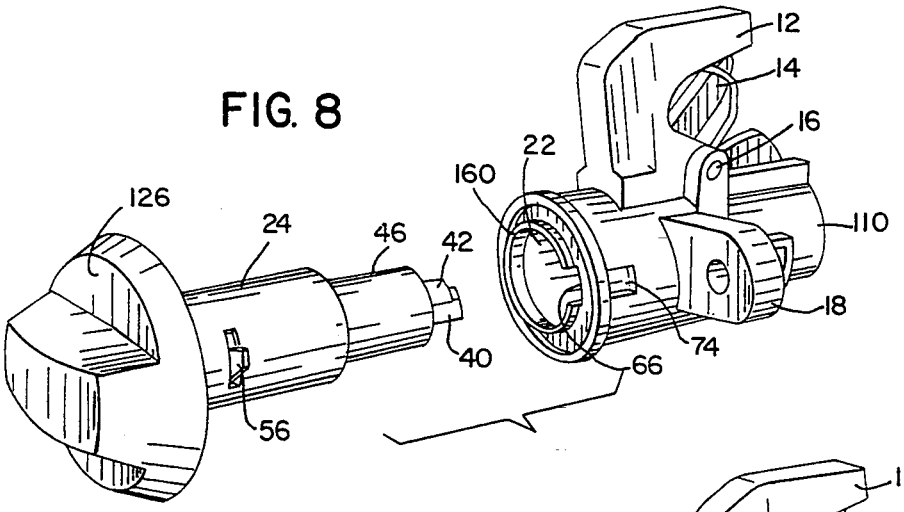
FIG. 9
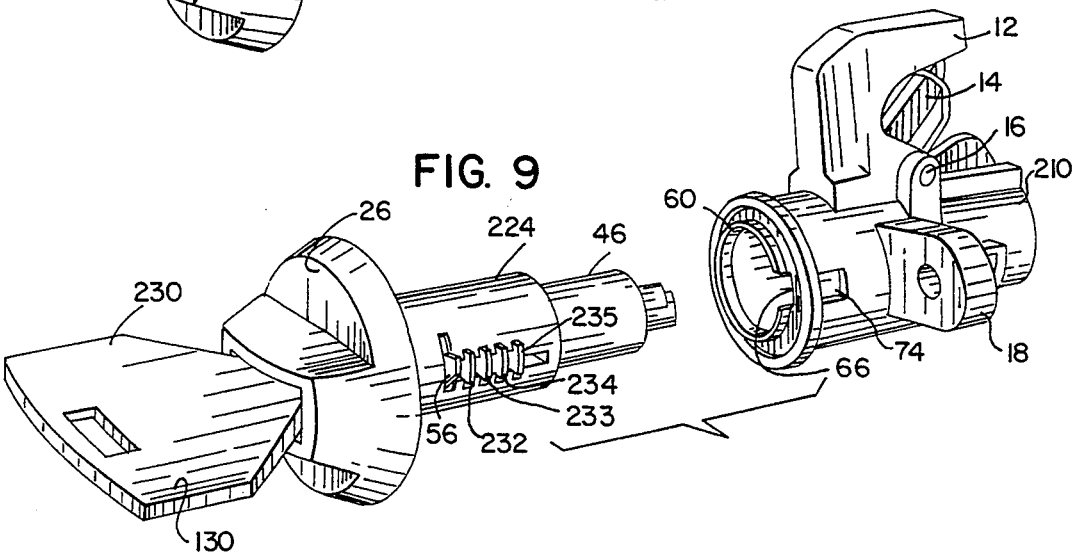
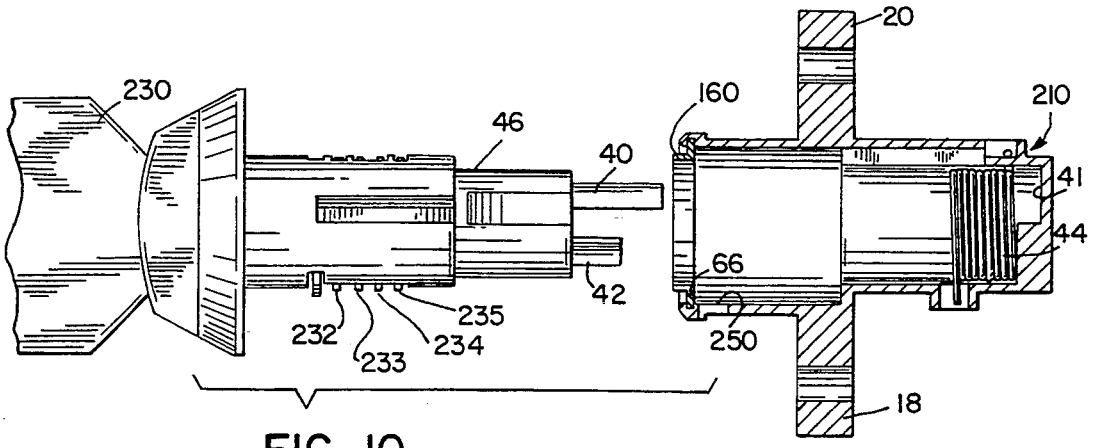
FIG. 10

CYLINDRICAL LOCK WITH CAM DOWN RETAINING TUMBLER

This application is a continuation of application Ser. No. 07/758,780, filed Sep. 12, 1991, now abandoned.

BACKGROUND OF THE INVENTION

1. Field of the Invention

The subject invention is generally related to cylinder lock and key sets and is specifically directed to a cylinder lock having a retaining tumbler which is operable without the use of a key.

2. Description of the Prior Art

Cylinder lock and key sets are well known. Typically, the cylinder is rotatably mounted in a sleeve, with the sleeve being permanently installed in a component having a controlled element which is moved between latched and unlatched positions in response to rotation of the cylinder in the sleeve. In keyed locks, the cylinder includes a key slot in communication with a plurality of tumblers, wherein insertion of a properly bitted key in the key slot engages the tumblers and removes them from interfering relationship with the sleeve to permit rotation of the cylinder to move it between the latched and unlatched positions. In unkeyed locks or latch systems, the cylinder is freely rotatable in the sleeve to move between the latched and unlatched positions.

Over the years, it has become common practice to retain the cylinder in assembled relationship with the sleeve by use of a retaining tumbler which is typically spring biased to an extended position with its outer tip in interfering relationship with the opening of the sleeve to preclude axial withdrawal of the cylinder relative to the sleeve after assembly. In most cases, a master key was utilized to withdraw the retaining tumbler into noninterfering relationship with the sleeve to facilitate insertion and removal of the cylinder. While this has been an acceptable design, it created difficult clearance problems when a double-bitted or reversible key was used in combination with the cylinder lock. In addition, this arrangement required redesign of the sleeve and cylinder configuration when non-keyed cylinder lock sets were used as, for example, in combination with glove compartment locks for automobiles and the like.

A number of prior art patents illustrate keyed retainer designs such as, by way of example, U.S. Pat. No. 2,444,542 entitled "Locking and Unlocking Mechanism for Cylinder LockS" issued to G. E. Swanson on Jul. 6, 1948; U.S. Pat. No. 2,629,247 entitled "Cylinder Lock" issued to L. E. Deutsch on Feb. 24, 1953; U.S. Pat. No. 4,272,975 entitled "Cylinder Lock With Key Removable Core" issued to G. P. Patriquin on Jun. 16, 1981; U.S. Pat. No. 4,516,415 entitled "Steering Lock for Automobiles" issued to S. Kobayashi et al on May 15, 1985; and U.S. Pat. No. 4,854,140 entitled "Plunger Lock Mechanism" issued to S. F. Goodman on Aug. 8, 1989.

In particular, the Patriquin patent discloses a cylinder retainer that allows insertion and removal of the cylinder from its sleeve when the retainer is retracted. The retainer is a tumbler located in the tumbler position nearest to the cylinder cap. When a standard key is inserted into the cylinder all of the tumblers will retract except for the retaining tumbler. However, the cylinder may be rotated because of a cam surface located on the retaining tumbler which forces the retaining tumbler inwardly, allowing rotation. A master key is used to retract all of the tumblers including the release tumbler in order to withdraw the cylinder from the sleeve.

The Deutsch patent also discloses a cylinder retaining device. A master key is inserted to withdraw all of the locking tumblers and a retaining tumbler which is not activated by a standard key. Once all of the tumblers are withdrawn by use of the master key, the cylinder may be removed.

All of the known locks of the prior art are either designed to operate the retaining tumbler with use of a master key or eliminate the retaining tumbler from the system where a master key is not utilized.

SUMMARY OF THE INVENTION

The subject invention provides for a cylinder lock set wherein a retaining tumbler is used for maintaining the cylinder in the receptive sleeve without requiring the use of a master key to either install the cylinder in the sleeve or later properly remove the cylinder from the sleeve. In the preferred embodiment of the invention, the retaining tumbler is disposed in the cylinder and includes an outer tip which extends beyond the perimeter of the outer peripheral wall of the cylinder. A beveled or cammed surface is provided in the outer tip of the retaining tumbler. A slot or aperture provided in the sleeve is adapted for receiving the outer tip of the retaining tumbler but is in interfering relationship with the outer tip when the retaining tumbler is in its fully extended position. When the cylinder is inserted in the sleeve and the outer tip of the retaining tumbler engages the receptive slot, the beveled or cammed surface on the outer tip engages one edge of the slot. As the cylinder is rotated, the beveled surface causes the retaining tumbler to cam down into the cylinder, clearing the interfering portion of the slot and permitting full insertion of the cylinder into the sleeve. Once the cylinder is fully inserted in the sleeve, the retaining tumbler is returned to its fully extended position and again is in interfering relationship with the slot, prohibiting unauthorized or inadvertent removal of the cylinder from the sleeve.

In keyed locks, the bitted key which is designed to engage and activate the locking tumblers does not come into contact or engage the retaining tumbler. Further, neither the bitted standard key nor a master key is required to operate the retaining tumbler during both installation and removal of the cylinder relative to the sleeve.

It is an important advantage of the subject invention that the non-keyed retaining tumbler configuration may be used not only with double bitted or reversible keys but also with single bitted keys and non-keyed cylindrical latching systems. This greatly facilitates the use of the lock in modern multiple lock systems such as, by way of example, vehicle lock systems wherein a standard single key is used for ignition locks, compartment locks and door locks.

It is, therefore, an object and feature of the subject invention to provide for a cylinder lock set which is readily adaptable for use with reversible keys, single bitted keys and non-keyed latch systems without modification of the retainer means for maintaining the cylinder in an installed relationship with the sleeve of the lock.

It is also an object and feature of the invention to provide for a cylinder lock set of the type utilizing a retaining tumbler for maintaining the sleeve and cylinder in assembled relationship wherein the cylinder may be installed in and removed from the sleeve without the use of a master key for engaging the retaining tumbler.

It is yet another object and feature of the subject invention to provide for a cylinder lock set wherein the cylinder may be inserted into a receptive sleeve by rotating the cylinder relative to the sleeve to withdraw the retaining tumbler into the cylinder for permitting insertion of the cylinder into the sleeve.

Other objects and features of the invention will be readily apparent from the accompanying drawing and detailed description of the preferred embodiments.

BRIEF DESCRIPTION OF THE DRAWING

FIG. 8 is an exploded perspective view similar to FIG. 2, showing a non-keyed cylinder lock.

FIG. 9 is an exploded perspective view similar to FIG. 2, showing a cylinder lock and key set having locking tumblers and a retaining tumbler operative in the same direction.

FIG. 10 is a view showing the embodiment of FIG. 10 in an orientation similar to FIG. 3.

DETAILED DESCRIPTION OF THE PREFERRED EMBODIMENTS

Figure 1:
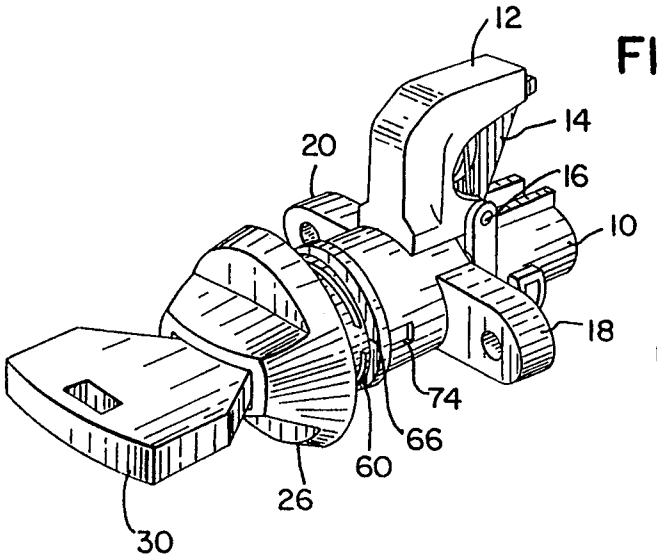
FIG. 1 is a perspective view of a cylinder lock and key set in accordance with the subject invention.

As shown in FIG. 1, the cylinder lock and key set of the subject invention comprises a sleeve 10 having a shroud 12 adapted for receiving a latch strike 14 which is pivotably mounted in the sleeve at the pivot 16. In typical use, the sleeve 10 is mounted on a door (not shown) such as, by way of example, a glove box door of a vehicle via the mounting tabs 18 and 20, with the open end 22 (FIG. 2) of the sleeve in communication with a suitable opening in the door. Typically, a bar or similar latch keeper 15 (shown in phantom in FIG. 4) is provided on the door assembly and is adapted for receiving and engaging the latch strike 14 for holding the door in a closed locked position.

Figure 2:
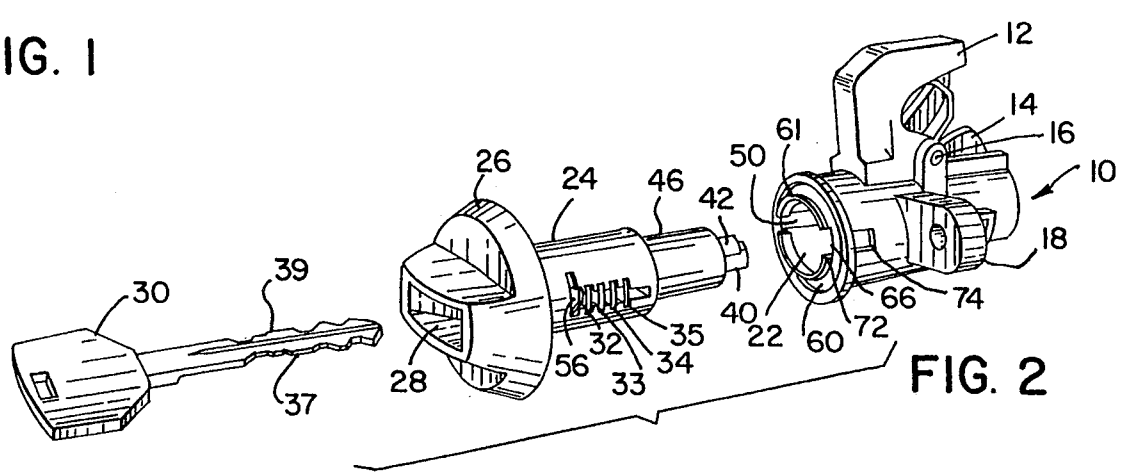
FIG. 2 is an exploded perspective view of the cylinder lock and key set of FIG. 1.

A cylinder 24 is adapted to be rotatably received by the sleeve 22 and includes a cap 26 with a key slot 28 for receiving a mated key 30. When a mated key 30 is inserted in the key slot 28, the locking tumblers 32, 33, 34 and 35 (see FIG. 2) are engaged by the mated bits 37 in the key 30, unlocking the cylinder from the sleeve and permitting rotation to open the latch strike 14 and permit opening of the door. In the embodiments of FIGS. 1–7, the cylinder and key lock set is provided with a reversible key having complementary identical bits 37 and 39 on the opposite edges thereof. This permits the key to be inserted in the lock irrespective of its orientation relative to the slot 28. It will be understood that a single bitted key could be used in accordance with the teachings of the present invention. In FIGS. 1 and 2, the locking tumblers 32, 33, 34 and 35 are in alignment with the retaining tumbler 56. In the embodiment of FIGS. 3-7, the locking tumblers 32–35 are diametrically opposite the retaining tumbler 56. In all other aspects, the embodiments are functionally identical.

Figure 3:
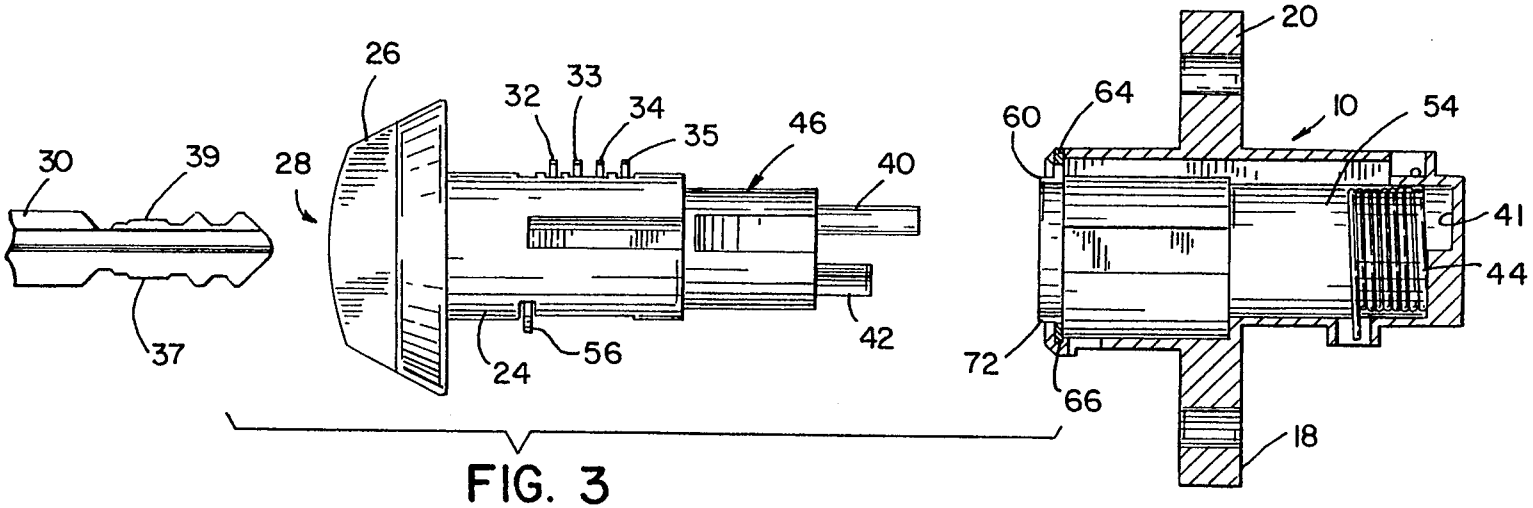
FIG. 3 is an exploded view of a cylinder lock and key set similar to that shown in FIGS. 1 and 2, partially in section, and rotated 90° to show the locking tumblers and retaining tumbler which are positioned diametrically opposite one another.
Figure 4:
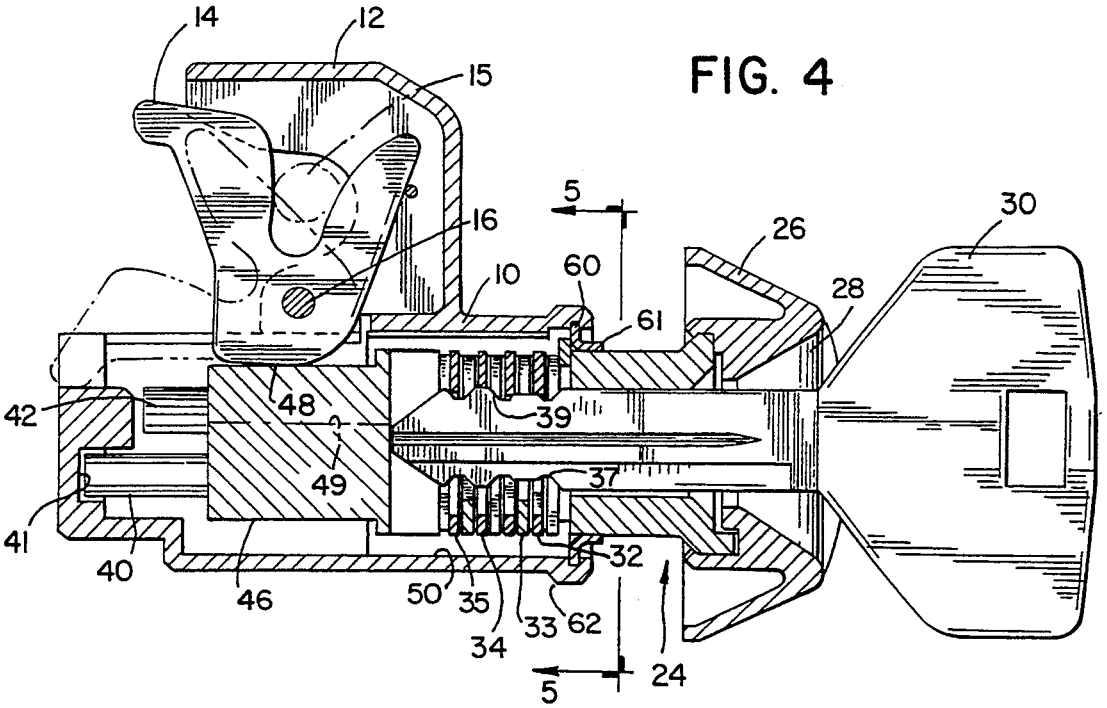
FIG. 4 is a view of the cylinder lock and key set of FIG. 3, with the cylinder in section to show the working relationship between the key and locking tumblers.

As is specifically shown in FIG. 3, a pair of fingers 40 and 42 extend beyond the end of the cylinder 24. Long finger 40 is received by the recess 41 provided in the closed end of the sleeve 10. The short finger 42 engages the coil spring 44 mounted in the sleeve 10. In typical fashion, when the cylinder 24 is rotated relative to a sleeve 10, the finger 42 recoils the spring 44, whereby the cylinder is biased to rotate back to a home position when it is released. An operating zone extension 46 is provided on the reduced outer end of the cylinder 24 and engages the lower surface 48 of the latch strike 14 (FIG. 4). When the cylinder 24 is rotated in a clockwise direction, the surface 46 is rotated to a further reduced portion 49, permitting the latch strike to pivot into the position shown in phantom in FIG. 4, releasing the keeper 15. When the cylinder is released, the spring 44 is operative to rotate the cylinder 24 counterclockwise (as shown) back to its home position for engaging and pivoting the latch strike back to the closed position shown in FIGS. 1, 2 and 4.

As is best shown in FIGS. 3-7, a tumbler channel 50 is provided in the sleeve 10. When the tumblers 32–35 are in the extended position shown in FIG. 3, they extend into the channel 50, precluding rotation of the cylinder 24 in the sleeve 10. When the properly bitted key 30 is inserted in the key slot, it engages and retracts locking tumblers 32–35 to the position shown in FIGS. 4–7, wherein the outer tips 52 of the tumblers clears the channel 50 and is beneath the interior peripheral wall 54 of the sleeve, permitting rotation of the cylinder in the sleeve.

Figure 5:
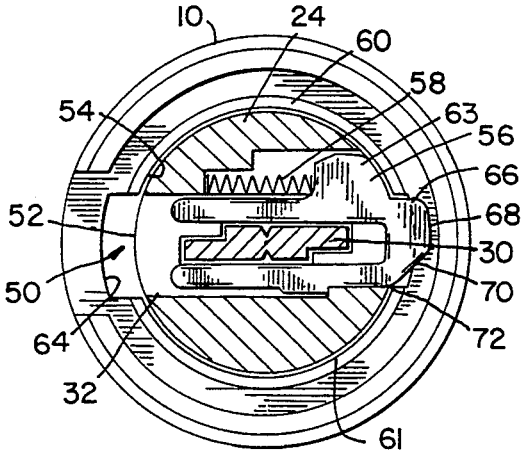
FIG. 5 is a section view taken generally along the line 5—5 of FIG. 4 and showing the retaining tumbler prior to full insertion of the lock cylinder into the sleeve.

In the preferred embodiments of the invention, a retaining tumbler 56 is provided in the sleeve between the locking tumblers and the cylinder cap 26. The retaining tumbler 56 is spring biased by the compression spring 58 to be continuously urged into the extended position best shown in FIGS. 3, 5 and 7. As is best shown in FIGS. 2 and 4, the outer opening 22 of the sleeve includes a closure ring 60 which is mounted in the peripheral channel 62 provided in the sleeve. In the embodiment of FIGS. 1 and 2, the tumbler channel of the sleeve is in alignment with the slot 66 provided in the closure ring 60. The locking tumblers 32-35 slide axially into slot 66 and the channel as the cylinder 24 is inserted in the sleeve 10. The retaining tumbler 56 is also inserted through the slot 66. As best seen in FIG. 5, when the locking tumblers 32–35 are opposite the retaining tumbler 56, the closure ring 60 includes a clearance slot 64 which permits the locking tumblers 32–35 to be inserted into the sleeve when in the extended position. A second clearance slot 66 is diametrically opposite slot 64 and is adapted to receive the outer tip 68 of the retaining tumbler 56.

In both embodiments, the outer tip 68 of the retaining tumbler extends beyond the channel 66, precluding entry of the cylinder into the sleeve and of the retaining tumbler 56 past the closure ring 60 unless the retaining tumbler is retracted to provide clearance between the outer tip 68 and the channel 66.

Figure 6:
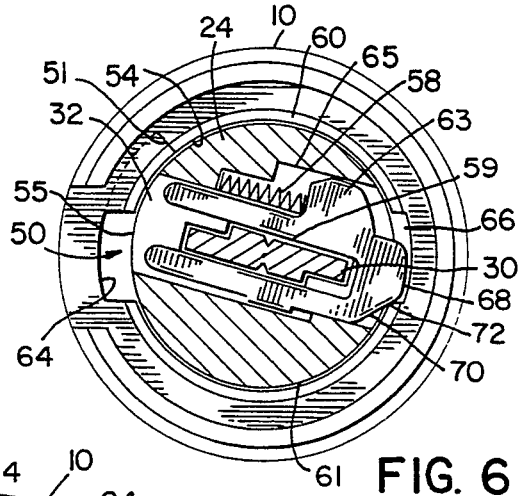
FIG. 6 is a view similar to FIG. 5, showing insertion and rotation of the cylinder into the sleeve.
Figure 7:
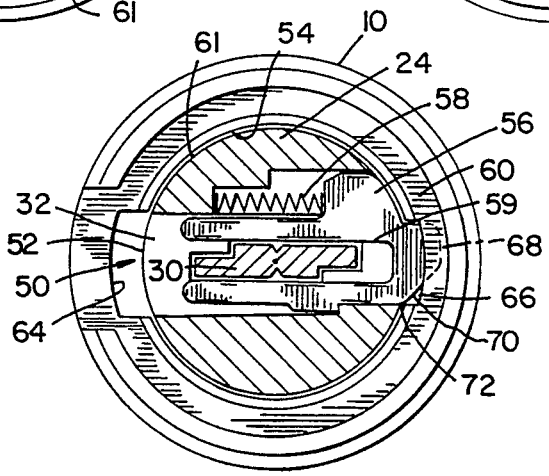
FIG. 7 is a view similar to FIG. 5, showing the retaining tumbler after the cylinder has been fully inserted in the sleeve.

As is best shown in FIGS. 5–7, the retaining tumbler 56 includes a beveled cam surface 70. When the cylinder 24 is inserted in the sleeve 10, the cammed portion of the extended retaining tumbler 56 enters into the axial portion 72 of the slot 66, as defined by the lip 61 of the ring 60. When the cylinder is rotated clockwise, as shown in FIG. 6, the beveled cam surface 70 engages the edge of the slot 72 and the retainer tumbler 56 is urged inwardly against spring 58, whereby the outer edge 68 of the retaining tumbler 56 clears the channel 66 and the cylinder may be fully inserted into the sleeve. Once the cylinder 24 is fully inserted into the sleeve, the retaining tumbler 56 is inward of the ring 60 (see FIGS. 4 and 7) and the spring 58 urges the tumbler to its fully extended position, locking the cylinder in the sleeve. The cylinder may be removed from the sleeve by inserting a suitable tool into the through aperture 74 (FIGS. 1 and 2) provided in the sleeve 10 for engaging and depressing the retaining tumbler 56 to its retracted position.

In the preferred embodiment, the retaining tumbler 56 is generally U-shaped and includes a central opening 59 providing an interference free clearance channel for the key 30. A tab 63 is provided on one side of the tumbler to define a spring seat for the spring 58. The tumbler is adapted to be received by and is slidably contained in a suitable recess 65 in the cylinder core.

In the embodiment of FIGS. 1 and 2, the key 30 must be inserted in the key slot 28 of the cylinder to retract the locking tumblers 32–35 to their recessed position in order to rotate the retaining tumbler 56 from the position of FIG. 5 to the position of FIG. 6. This is required to permit the outer tips 52 of the locking tumblers to clear the inner peripheral wall 54 of the sleeve.

An important feature of the embodiment of FIGS. 3–7 is the ability to insert the cylinder into the sleeve without the key. The slot 64 in the closure ring is approximately the same size as the respective locking tumblers 32–35. However, the channel 50 may be widened enough, as indicated by end wall 51 (shown in phantom), to permit slight rotation of the cylinder (see FIG. 6), allowing the retaining tumbler to cam-down below the outer edge 68 of slot 66, thus allowing full insertion of the sleeve into the cylinder.

As shown in FIG. 8, it is also a feature of the subject invention that the cylinder lock assembly may be used with or without a key lock system. The locking tumblers may be deleted and the modified cap 126 may be utilized to provide a turn knob for turning the cylinder 24 in the sleeve 10 without use of a key. The retaining tumbler 56 is adapted to be received in the slot 66 and functions in the same manner as previously described. Since the locking tumblers are not present in the configuration of FIG. 8, the locking tumbler channel 50 has been deleted from the modified sleeve 110 and the locking tumbler slot 64 has been deleted from the modified ring 160.

As previously stated and as shown in FIGS. 9 and 10, it is also a feature of the subject invention that the cam-down retaining tumbler 56 may be utilized in combination with a single bitted key 230 and/or locking tumblers 232–235 which extend radially outward from the modified cylinder 224 in the same direction as the retaining tumbler 56. In this configuration, the channel 66 of the closure ring 60 receives both the locking tumblers 232–235 and the retaining tumbler 56. As shown in FIG. 10, an elongate, axially extending channel 250 is provided in the modified sleeve 210 in alignment with the ring slot 66 to provide a locking channel for the tumblers 232–235. The retaining tumbler 56 operates in the same manner as previously described.

Where disassembly is required, a probe (not shown) may be inserted in the opening 74 to depress the retaining tumbler 56 and permit axial withdrawal of the cylinder from the sleeve.

While specific features and embodiments of the invention have been described herein, it will be readily understood that the invention encompasses all modifications and enhancements within the scope and spirit of the following claims.

We claim:

1. In a cylinder lock having a sleeve including a longitudinal axis, an open outer end and an inner peripheral wall, a cylinder having an outer peripheral wall and adapted to be inserted in and rotatably carried by the sleeve, the cylinder rotatable between a home position and an advanced position, and means for retaining the cylinder in assembled relationship within the sleeve, an improvement comprising:

a retractable retaining tumbler carried in said cylinder, said retaining tumbler disposed in a plane perpendicular to said longitudinal axis and radially slidably movable in said plane between an extended position and a retracted position, and said retaining tumbler having a tip normally extending radially outward beyond the outer peripheral wall of the cylinder, the tumbler movable to a retracted position wherein the tip is moved inwardly toward the axis of the cylinder and the sleeve;

b. an axially extending retaining tumbler-receiving aperture formed in the sleeve for slidably receiving said retaining tumbler, said aperture in communication with the outer open end of the sleeve and having a top and at least one cam-engaging axially extending side edge, the top of said aperture being disposed in interfering relationship with the tip of said tumbler when the tumbler is in its extended position; and c. a circumferentially extending inclined cam surface on the tip of the tumbler and disposed to engage the side edge of the aperture as the cylinder is axially inserted in the sleeve, whereby the cam surface engages said side edge and drives the tumbler into the cylinder as the cylinder is rotated relative to the sleeve.

2. The lock of claim 1, further including biasing means in said cylinder and engaging said tumbler for normally urging the tumbler toward its extended position.

3. The lock of claim 1, further including:

a. a key-slot in said cylinder for receiving an elongate key; and b. locking means carried in the cylinder and movable between a locked position and an unlocked position, said locking means precluding rotation of the cylinder relative to the sleeve when in the locked position and responsive to insertion of the key in said key-slot to move to the unlocked position for permitting rotation of the cylinder relative to the sleeve.

4. The lock of claim 3, wherein said retaining tumbler is disposed in non-interfering relationship with said key slot and said key when inserted therein.

5. The lock of claim 1, further including a ring mounted on the open outer end of the sleeve, said ring including a central opening adapted for receiving the cylinder and wherein said tumbler aperture is in said ring and in communication with said central opening.

6. The lock of claim 5, said ring further including a radially extending wall and an axially extending wall, and wherein the top of said aperture is in the radially extending wall and the cam engaging side edge of said aperture is in the axially extending wall.

7. The lock of claim 5, wherein said sleeve further includes a through aperture adjacent its open outer end and adjacent the tumbler aperture in said ring, whereby access to said tumbler may be gained through said aperture when the cylinder and sleeve are in assembled relationship.

8. The lock of claim 3, wherein said tumbler is of a U-shaped cross-section and wherein the key slot of the cylinder passes between the two legs of the U.

9. The lock of claim 8, said tumbler further including a tab extending radially outwardly from one leg of the U and wherein said biasing means is in communication with said tab.

10. The lock of claim 9, wherein said biasing means comprises an elongate compression spring having opposite ends in communication with said tab and said cylinder, respectively.

11. The lock of claim 1, further including biasing means in said sleeve and engaging said cylinder for normally urging the cylinder to the home position.

12. In a cylinder lock having a hollow sleeve with a closed end and an open outer end and a longitudinal axis, a cylinder having an outer peripheral wall and adapted to be inserted in and disposed in axial alignment with said sleeve, the cylinder rotatable relative to said sleeve between a home position and an advanced position, and means for retaining the cylinder in assembled relationship within the sleeve, said retaining means comprising:

a. a retractable retaining tumbler carried in said cylinder, said retaining tumbler disposed in a plane perpendicular to said longitudinal axis and radially slidably movable in said plane between an extended position and a retracted position, and said retaining tumbler having a tip normally extending radially outward beyond the outer peripheral wall of the cylinder;

b. a ring mounted on the open outer end of the sleeve, said ring including a radially extending wall and an axially extending wall defining a central opening adapted for receiving the cylinder and an axially extending retaining tumbler-receiving aperture formed in said axially extending wall for slidably receiving said retaining tumbler, said aperture in communication with said central opening, the tumbler aperture having a top and at least one cam engaging axially extending side edge, the top of said aperture being disposed in interfering relationship with the tip of said tumbler when the tumbler is in its extended position and wherein the top of said aperture is in the radially extending wall and the cam engaging side edge of said aperture is in the axially extending wall; and c. a circumferentially extending inclined cam surface on the tip of the tumbler and disposed to engage the side edge of the aperture as the cylinder is inserted axially into the sleeve, whereby the cam surface engages said side edge and drives the tumbler into the cylinder as the cylinder is rotated relative to the sleeve.

13. The lock of claim 12, further including:

a key slot in said cylinder for receiving an elongate key;

b. locking tumblers carried in the cylinder and movable between extended locking positions and retracted unlocking positions, said locking tumblers precluding rotation of the cylinder relative to the sleeve when in the locking position and responsive to insertion of a properly bitted key in said key slot to move the locking tumblers from the locking position to the unlocking position for permitting rotation of the cylinder relative to the sleeve, wherein said retaining tumbler is disposed in noninterfering relationship with said key slot and said key when inserted in said slot.

14. The lock of claim 13, wherein said retaining tumbler is of a U-shaped cross-section and wherein the key slot of the cylinder passes between the two legs of the U.

15. The lock of claim 14, said retaining tumbler further including a tab extending radially outwardly from open leg of the U, and further including biasing means in said cylinder having opposite ends engaging said tab and said cylinder for normally urging the retaining tumbler toward its extended position.

16. The lock of claim 12, wherein said sleeve further includes a through aperture adjacent is open outer end and adjacent the retaining tumbler aperture in said ring, whereby access to said retaining tumbler may be gained through said aperture when the cylinder and sleeve are in assembled relationship.

* * * * *

UNITED STATES PATENT AND TRADEMARK OFFICE

CERTIFICATE OF CORRECTION

PATENT NO. :5,355,703

DATED :October 18, 1994

INVENTOR(S) :KEVIN J. ELINSKI ET AL

It is certified that error appears in the above-indentified patent and that said Letters Patent is hereby corrected as shown below:

| | |
|---|---|
| CLAIM 1<br>Col. 6, line 24 | Before "a retractable" insert ---a.--- |
| CLAIM 15<br>Col. 8, line 41 | Delete the words "open leg" and substitute therefore ---one leg--- |
| CLAIM 16<br>Col. 8, line 46 | After the word "adjacent" delete the word "is" and substitute therefore ---its--- |

Signed and Sealed this

Second Day of May, 1995

*Attest:*

*Attesting Officer*

BRUCE LEHMAN

*Commissioner of Patents and Trademarks*